United States Patent [19]

Inoue

[11] Patent Number: 4,549,632

[45] Date of Patent: Oct. 29, 1985

[54] LADDER

[75] Inventor: Shunsaku Inoue, Ikeda, Japan

[73] Assignee: Alinco Incorporated, Takatsuki, Japan

[21] Appl. No.: 566,948

[22] Filed: Dec. 30, 1983

[51] Int. Cl.[4] ..... E06C 1/383

[52] U.S. Cl. ..... 182/23; 182/160; 182/162

[58] Field of Search ..... 182/159, 160, 161, 162, 182/23, 24

[56] References Cited

U.S. PATENT DOCUMENTS

| | | | |
|---|---|---|---|
| 341,284 | 5/1886 | Sharp | 182/162 |
| 357,233 | 2/1887 | Russell | 182/162 |
| 1,894,489 | 1/1933 | Hirose | 182/23 |
| 2,727,671 | 12/1955 | Ollerhead | 182/160 |
| 4,284,171 | 8/1981 | Owen | 182/27 |

FOREIGN PATENT DOCUMENTS

| | | | |
|---|---|---|---|
| 46626 | 6/1917 | Sweden | 182/163 |

*Primary Examiner*—Reinaldo P. Machado
*Attorney, Agent, or Firm*—Gabriel P. Katona

[57] ABSTRACT

A ladder wherein a plurality of rounds are pivotally and turnably mounted to and between the right stanchion and the left stanchion at proper spaces, and supporting arm levers are detachably fixed from both stanchions to the round by bolts or machine screws.

1 Claim, 12 Drawing Figures

LADDER

BACKGROUND OF THE INVENTION

The present invention relates to a ladder made of a light alloy such as aluminum or the like. Conventionally there have been such a telescopic type of ladders wherein a plurality of rounds are provided between the right and left stanchions which are formed telescopically and both stanchions are extended in use. Also there have been such a folding type of ladders wherein the ladder can be folded in a A-shape at the central region of the stanchions and it is unfolded in use. But these conventional ladders have limitations in their compactification because they should be maintained in a ladder form wherein a plurality of rounds are fixingly provided between both stanchions. In order to transport many ladders to a remote place or to store them for a long time, it is desirable that they can be folded as compactly as possible. But ladders with a folding construction have such defects that the folding portions become weakened in the course of use. Ladders, however, should have sufficient durability as to bear the load exerted thereon when they are used.

OBJECTS OF THE INVENTION

Therefore, the object of the present invention is to provide a ladder wherein a plurality of rounds are compactly folded in a link form between both the right and left stanchions forming the ladder and it can compactly be folded substantially into a bar-like form, thereby it is made not bulky so as to be convenient for transportation or storage.

Another object of the present invention is to provide a ladder which is not only convenient for transportation and storage as a result of being folded in a bar-like form as mentioned above, but also durable enough to bear the load in use by considering sufficiently as to its reinforcement in use as a ladder or a stepladder and increasing the strength of the folding portions.

Further object of the present invention is to provide a ladder which is as simple as possible in its construction and can be assembled easily when it is used.

BRIEF DESCRIPTION OF THE DRAWINGS

The appended drawings show embodiments of the present invention, wherein

FIG. 4*b* is a sectional view taken on line IV*b* —IV*b* of FIG. 4*a.

DETAILED DESCRIPTION OF THE INVENTION

Figure 1A:
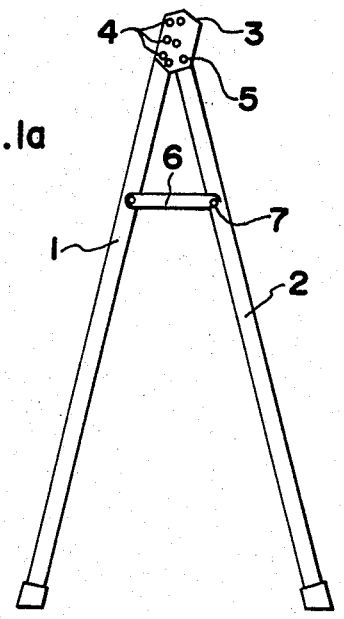
FIG. 1*a* is an elevation showing a state of use of the ladder as stepladder.

Referring to the drawings, there will be given explanations of the embodiments of the present invention.

Figure 1B:
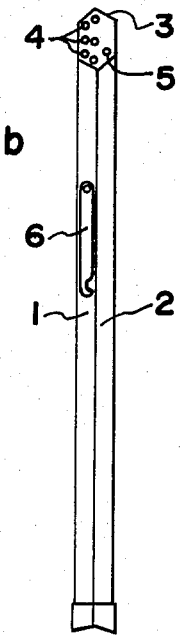
FIG. 1*b* is an elevation showing a folded state of the ladder.

As shown in FIGS. 1*a* and 1*b*, hinge plates 3 made of steel, iron plate or the like are fixed to a main ladder 1 and a subordinate ladder 2 in such a manner that a half of the width of each hinge plate 3 is fixed to the main ladder 1 on both the right and left sides in a front to rear direction at the upper end portion of the main ladder by machine screws 4 or the like and the other half of the width of each hinge plate 3 is turnably fixed by pivots 5 to the subordinate ladder 2 on both the right and left sides in a front to rear direction at a lower place of the upper end portion of the subordinate ladder. In this case the subordinate ladder 2 is made slightly shorter than the main ladder 1. By allowing interlocking metal fittings 6 pivotally mounted to the main ladder 1 to interlock with interlocking pins 7 provided on and projecting from the subordinate ladder 2, the main and subordinate ladders 1, 2 are maintained A-shapedly and can be used as a step-ladder. By allowing the interlocking metal fittings 6 to detach from the interlocking pins 7, both ladders 1, 2 can be superposed each other to be folded in a single-bar-like shape. In the next place, as shown in FIGS. 1*c* and 1*d*, rounds 9 provided between stanchions 8*a* and 8*b* constructing the ladder 1 or 2 are pivotally and turnably mounted by pivots 10*a*, 10*b*, and at the same time respective lower end portions 11*a*, 11*b* of the stanchions 8*a*, 8*b* are formed curvedly in a widening form toward the end with the round 9*a* between.

Figure 1C:
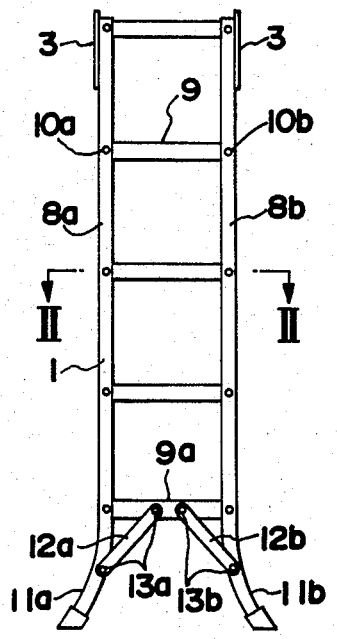
FIG. 1*c* is a side view showing a state of use of the same.

As shown in FIG. 1*c*, normally supporting arm levers 12*a*, 12*b* are fixed by machine screws 13*a*, 13*b* from the round 9*a* to the curved lower end portions 11*a*, 11*b* of the stanchions to maintain both stanchions 8*a*, 8*b* and the rounds 9 as a ladder. At the same time, as shown in FIG. 1*e*, it is possible to make both stanchions 8*a*, 8*b* superpose each other and to fold the rounds 9 between both stanchions 8*a*, 8*b* by removing machine screws 13*a*, 13*b* and turning the rounds 9 in such a manner that each of the rounds draws a locus of a link until the ladder comes to take substantially a form of a bar, thereby the bulk of the ladder can be reduced. As a result, the ladder can conveniently be transported and stored. In the embodiment shown in FIG. 1*c*, each of the supporting arm levers 12*a*, 12*b* is separately fixed to the round 9*a*.

Figure 1D:
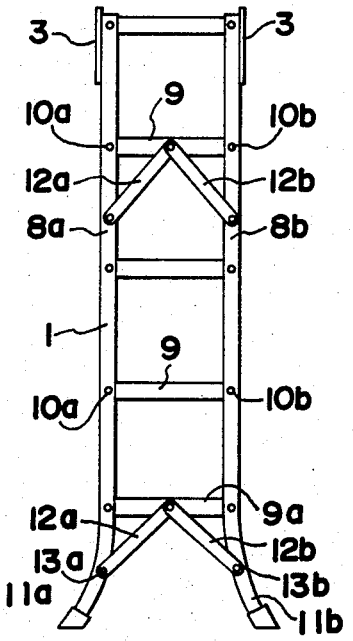
FIG. 1*d* is a side view showing a state of use of the same in other embodiment.
Figure 1E:
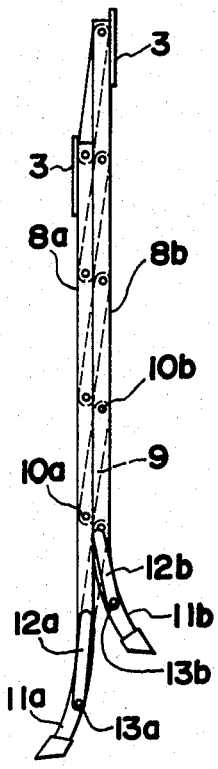
FIG. 1*e* is a side view showing a folded state of the same.
Figure 3A:
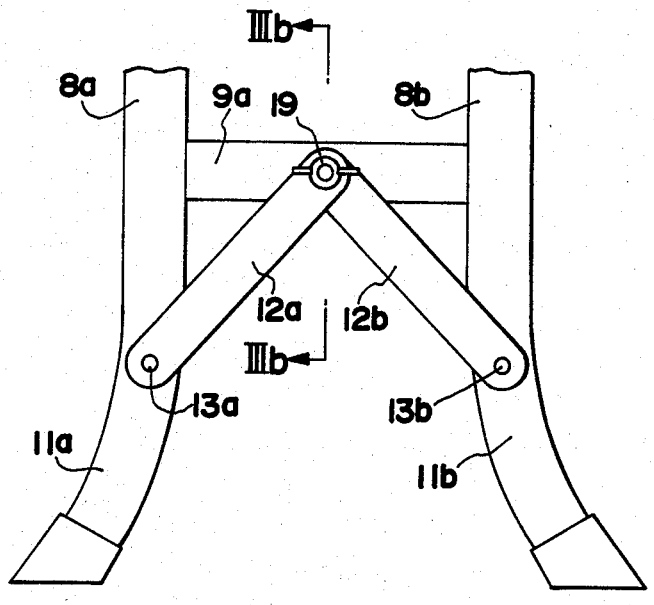
FIG. 3*a* is an enlarged view of the principal part of the ladder shown in FIG. 1*d;*
Figure 3B:
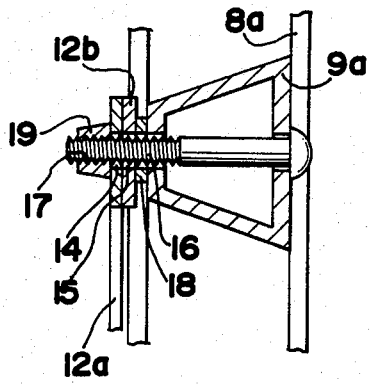
FIG. 3*b* is a sectional view taken on line III*b*—III*b* of FIG. 3*a;*

But there is also other embodiment as shown in FIG. 1*d*, and more in particular, in FIGS. 3*a* and 3*b*. That is, one end portion of the band-shaped supporting arm levers 12*a*, 12*b* made of iron plate or the like are pivotally and turnably mounted to the lower end portions 11*a*, 11*b* by pins 13*a*, 13*b* respectively. Furthermore, a hole 16 for penetrating a bolt or a machine screw is provided at the central region of the lowermost round 9*a*, while holes 14, 15 for penetrating bolts or machine screws are provided at the free end portions of the supporting arm levers 12*a*, 12*b*. Then, superposing each free end portion of the supporting arm levers 12*a*, 12*b* each other, permitting respective holes 14, 15 to coincide concentrically with the hole 16 of the round 9*a*, penetrating a machine screw or a bolt 17 through these holes and screwing a butterfly nut or an ordinary nut 19 through a washer 18 at the top portion thereof, each free end portion of the supporting arm levers 12*a*, 12*b* is coaxially mounted to the round 9*a* at the central region thereof. Since, according to this embodiment, it is possible to fold and assemble the ladder merely by screwing and unscrewing a nut 19, the work is all the more easy. Moreover, as shown in FIG. 1*d*, it is also possible to provide auxiliary supporting arm levers 12*a*, 12*b* which are to be mounted in the same manner from both stanchions 8*a*, 8*b* to each round or to one or several rounds where necessary.

Figure 1F:
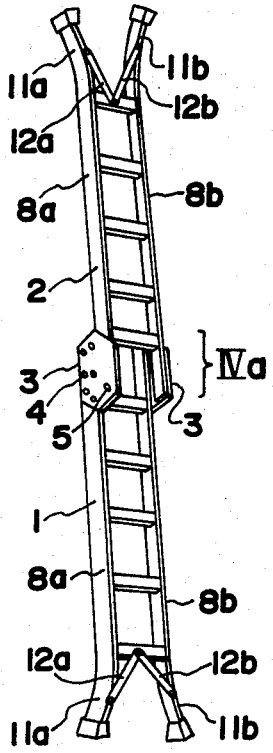
FIG. 1*f* is a perspective view of a state of use as ordinary ladder.
Figure 2:
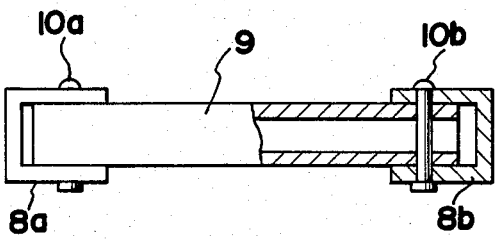
FIG. 2 is a sectional view taken on line II—II of FIG. 1*c;*

As shown in FIG. 1*f*, the ladder according to the present invention can be used as a single long ladder by making the subordinate ladder 2 turn with the pivots 5 of the hinge plates 3 being its supporting points and extend linearly in a parallel to the main ladder 1. Since in this case both end portions of the main and subordinate ladders are formed curvedly in a widening form toward the end, this ladder shows a remarkably great steadiness against the ground plane and the suspension plane at height.

Figure 4A:
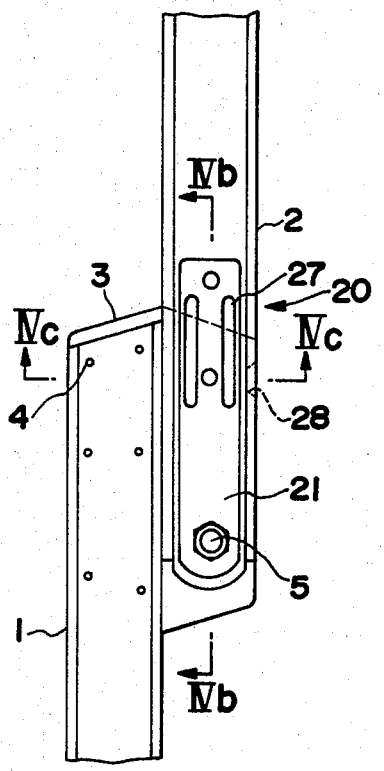
FIG. 4*a* is an enlarged side view of the part shown under IV*a* in FIG. 1*f;*
Figure 4B:
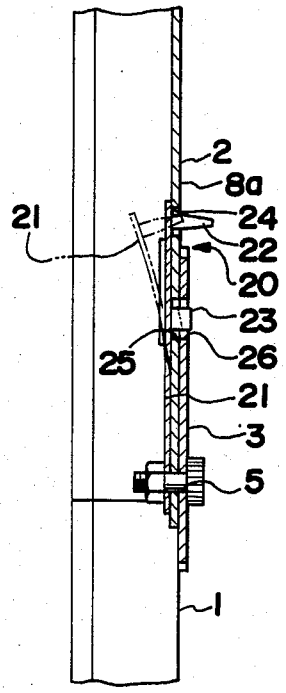
Figure 4C:
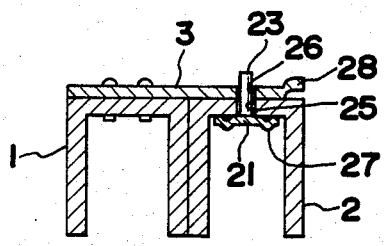
* and FIG. 4*c* is a sectional view taken on line IV*c*—IV*c* of FIG. 4*a.*

FIGS. 4*a* to 4*c* show a locking means 20 which is the detailed structure at the portion A shown in FIG. 1*f* when the main ladder 1 and the subordinate ladder 2 are extended linearly. That is, when hinge plates 3 are pivotally mounted to the upper end portion of the subordinate ladder 2 by pivots 5, a plate spring 21 is fixed to said pivot 5 at the back surface of the stanchion 8*a* (or 8*b*) forming the subordinate ladder 2, an operational button 22 and a locking button 23, less projecting than the operational button 22, are fixed to the free end of the plate spring 21. A hole 24 wherein the operational button 22 may enter freely is provided on the stanchion 8*a*. Locking holes 25, 26 wherein the locking button 23 can freely enter coaxially are provided on the stanchion 8*a* and on the hinge plate 3 respectively. A reinforcement rib 27 is provided to the plate spring 21 so that the latter may exhibit sufficient restoring force. As shown in FIG. 4*a*, more in particular in FIG. 4*c*, a frame for guide groove 28 is curvedly formed at the edge of the lateral side of the hinge plate 3 so that the locking button 23 may interlock easily. Therefore, as the subordinate ladder 2 turns with respect to the main ladder 1, the locking button 23 comes to contact to the frame for guide groove 28 provided at the edge of the side end of the hinge plate 3, is guided by said frame to slide, and as a result, when the subordinate ladder 2 comes to be rectilineal with respect to the main ladder 1, the locking button 23 is pushed by the plate spring 21 and enters the locking hole 26, thereby the subordinate ladder 2 is prevented from turning and the safety of the ladder when it is used as a long ladder is increased. Since the operational button 22 is formed in such a manner that its amount of projection is slightly greater than that of the locking button 23, as shown in FIG. 4*b* by a dashed line, in folding the subordinate ladder 2, the locking button 23 slips out of the locking hole 26 of the hinge plate 3 by pushing the operational button 22. As a result, the subordinate ladder 2 can be folded without being prevented.

As mentioned above, according to the present invention, a plurality of rounds 9 are pivotally and turnably mounted between the right and left stanchions 8*a*, 8*b*, and supporting arm levers 12*a*, 12*b* are detachably mounted ranging over the stanchions 8*a*, 8*b* and the round 9 by machine screws or bolts, and by detaching the supporting arm levers, both stanchions can be folded superposingly in such a manner that the rounds 9 are stored between both stanchions, so that the ladder may become compact into a single bar-like shape as a whole, and is very convenient for transportation and storage.

Also according to the present invention, not only the lowermost round is reinforced but also each round and both stanchions are maintained in a rectangular relationship by mounting the supporting arm levers 12*a*, 12*b* between the lower end portion of each stanchion, 8*a*, 8*b* and the round 9 by bolts or machine screws. Consequently, sufficient durability can be assured against the load exerted on the ladder.

According to the embodiment of the present invention, each end portion of the supporting arm levers 12*a*, 12*b* is pivotally and turnably mounted to the lower end portion of the stanchions, and at the same time each free end portion is detachably mounted to the central portion of the round by a bolt or a machine screw passing coaxially. As a result, the assembling work of the ladder is very simple, for merely fixing by a bolt and a nut at a place is required.

Also according to the embodiments of the present invention, each lower end portion of both stanchions 8*a*, 8*b* is formed curvedly in a widening form toward the end with the round 9*a* between. Therefore, when the ladder is used as a stepladder or a long ladder, it shows a remarkably great steadiness against the ground plane and the suspension plane at height. Generally speaking, if the lower end portion of the stanchions is formed curvedly in a widening form toward the end, there is a danger of both lowermost portions being further deformed due to the load in use. In contrast to this, according to the embodiments of the present invention, such a deformation can surely be prevented by mounting the supporting arms between the lower end portion of the stanchions and the round by machine screws or bolts in a trussed position. Moreover, the more load exerts on the ladder, the more the supporting arm levers 12*a*, 12*b* are pulled in the widening direction toward the end of the stanchions, all the more such multiplying actions that the incidence of the rattling is effectively prevented and both stanchions 8*a*, 8*b* and the rounds 9 are maintained in a form of a ladder.

Furthermore, according to the embodiments of the present invention, not only there is an increase in safety in use of the ladder as a long ladder because a locking means 20 which locks the subordinate ladder 2 into the hinge plate 3 automatically when the subordinate ladder 2 turns and is extended linearly with respect to the main ladder 1 is provided ranging over the hinge plate 3 and the subordinate ladder 2, but also it is convenient for use because any manual locking operation is not necessary.

What is claimed is:

1. A ladder comprising a main ladder and a subordinate ladder having hinge plates attached to the upper end of each of the main and subordinate ladders, said ladders each having a pair of stanchions joined by a plurality of rungs, and supporting arm levers, wherein (a) each rung is pivotably and turnably mounted to both stanchions:

(b) said supporting arm levers each with one end pivotably and turnably mounted to a stanchion and the other free end of each coaxially detachably mounted directly to the central region of a rung;

(c) the lower end of each stanchion being curvedly formed in a widening form below the lowest rung between the stanchions;

(d) half the width of each hinge plate is fixed to the upper end portion of the main ladder and the other half of the width of each hinge plate is pivotably and turnably mounted to the upper end portion of the subordinate ladder which is slightly shorter than the main ladder and;

(e) said locking means ranging over said hinge plates and the subordinate ladder automatically locks the subordinate ladder into the hinge plates when the subordinate ladder is turned and extended linearly with respect to the main ladder.

* * * * *